United States Patent [19]

Drori

[11] 4,121,769

[45] Oct. 24, 1978

[54] ROTARY SPRAYING DEVICE PARTICULARLY USEFUL FOR WATER IRRIGATION

[76] Inventor: Mordeki Drori, 89 Zahal St., Kiron, Israel

[21] Appl. No.: 724,007

[22] Filed: Sep. 16, 1976

[30] Foreign Application Priority Data

| | | | |
|---|---|---|---|
| Apr. 14, 1976 | [IL] | Israel | 49414 |
| Apr. 26, 1976 | [IL] | Israel | 49472 |
| May 20, 1976 | [IL] | Israel | 49615 |

[51] Int. Cl.[2] ..... B05B 3/06

[52] U.S. Cl. ..... 239/222.17; 239/251

[58] Field of Search ..... 239/214.15, 222.17, 239/251, 261, 381, 383

[56] References Cited

U.S. PATENT DOCUMENTS

| | | | |
|---|---|---|---|
| 453,055 | 5/1891 | Ware | 239/504 X |
| 1,239,230 | 9/1917 | Shaw | 239/222.17 X |
| 2,273,401 | 2/1942 | Ferrando et al. | 239/222.17 |
| 3,125,297 | 3/1964 | Copeland et al. | 239/251 X |
| 3,385,523 | 5/1968 | Stouder | 239/261 |
| 3,558,057 | 1/1971 | Akhmedov et al. | 239/261 |

FOREIGN PATENT DOCUMENTS

| | | | |
|---|---|---|---|
| 128,208 | 7/1948 | Australia | 239/222.17 |

*Primary Examiner*—John J. Love

*Attorney, Agent, or Firm*—Benjamin J. Barish

[57] ABSTRACT

A rotary liquid spraying device comprises a nozzle and a liquid spraying head rotatably mounted to the nozzle, the spraying head including an internal chamber having a shaped inlet orifice receiving the jet from the nozzle, and a plurality of outlet orifices which produce lateral jets and a reaction force for rotating the head. The internal chamber is of substantially larger cross-sectional area than either the inlet, or all the outlet orifices together, to define a reservoir in which the velocity of the nozzle jet is substantially reduced and is used to pressurize the liquid before it is issued at a high velocity through the outlet orifices. The shaped inlet orifice includes side walls converging towards each other in the direction of the inlet chamber and terminating in a narrow diameter throat at the mouth of the chamber.

12 Claims, 18 Drawing Figures

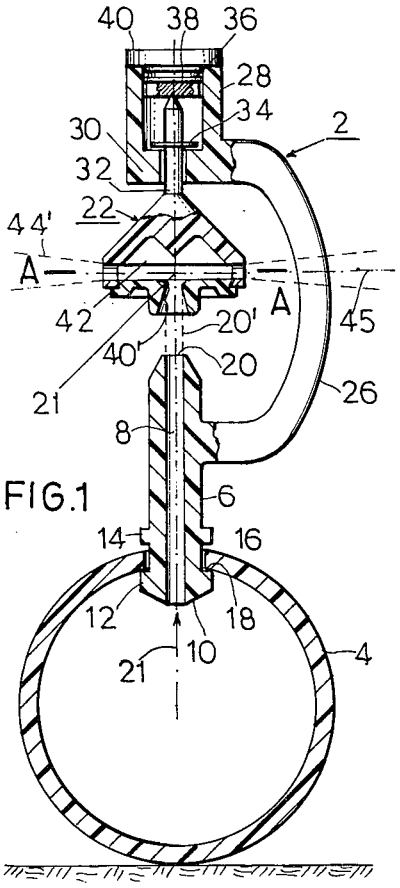
FIG.1
FIG.1a
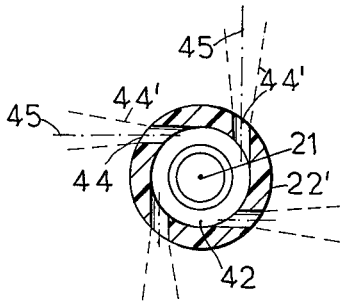
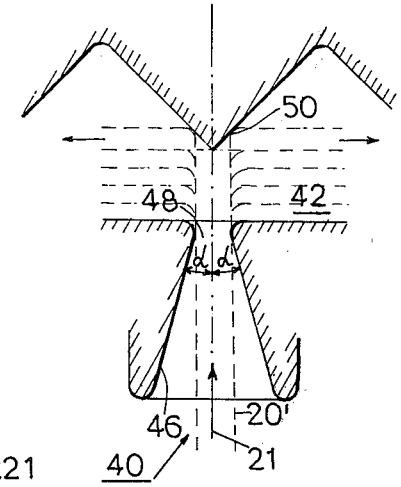
FIG.1b
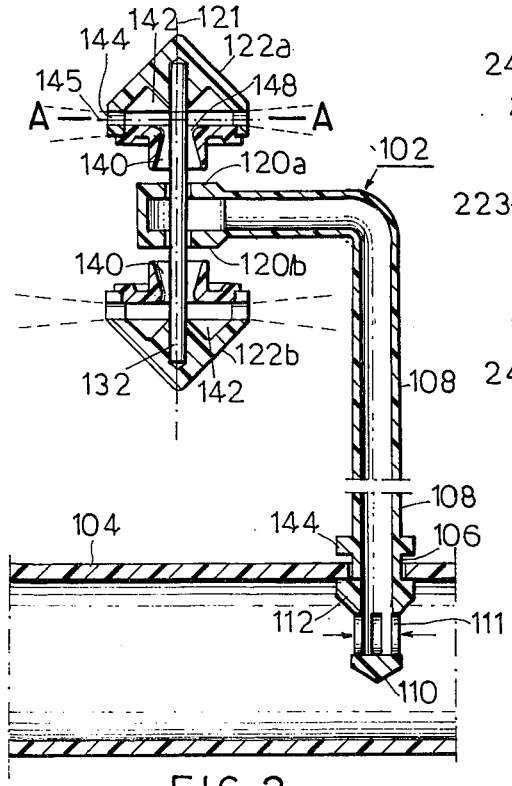
FIG. 2
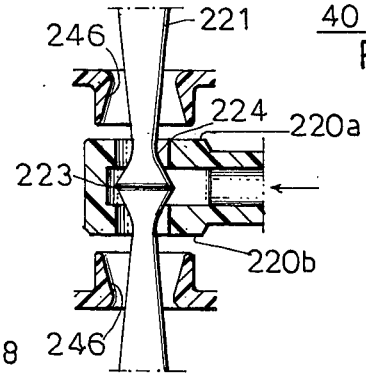
FIG. 2b
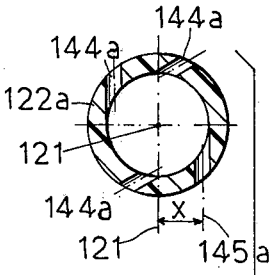
FIG.2a
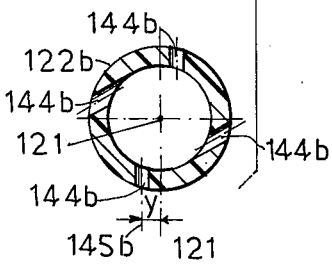

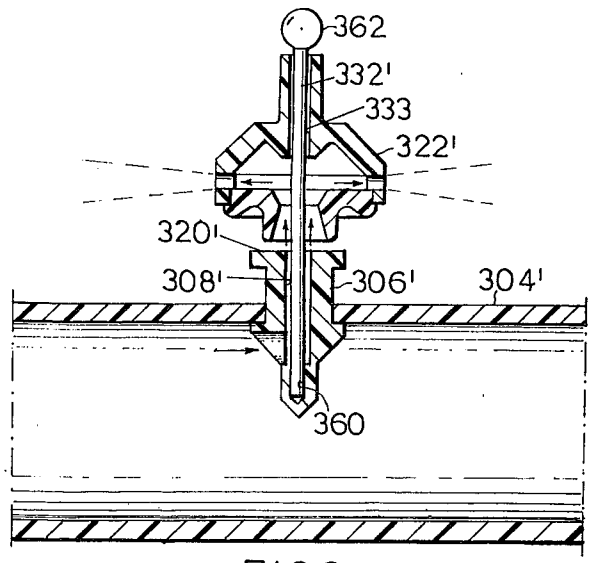
FIG.9
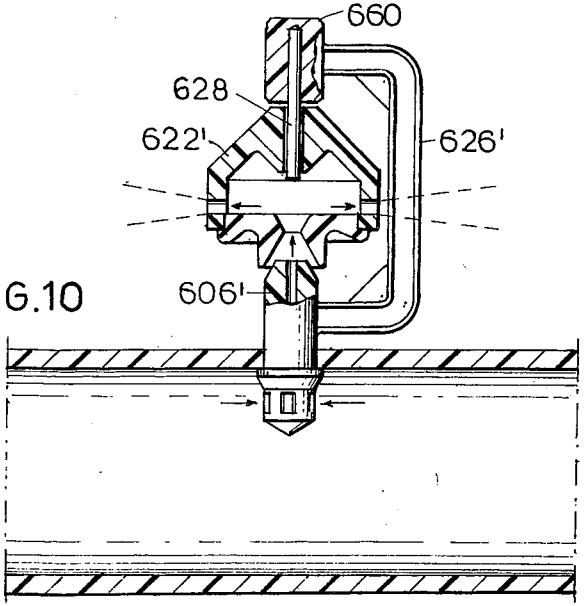
FIG.10
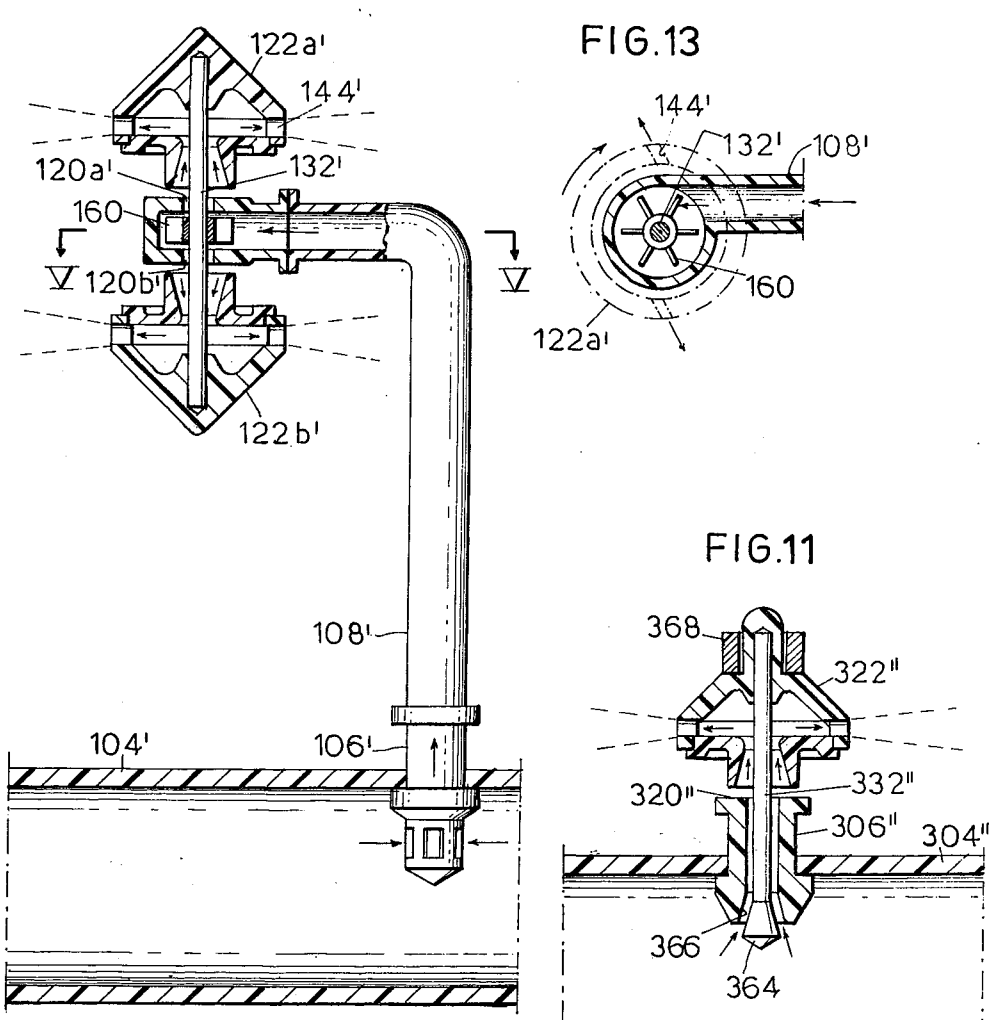
FIG.12
FIG.13
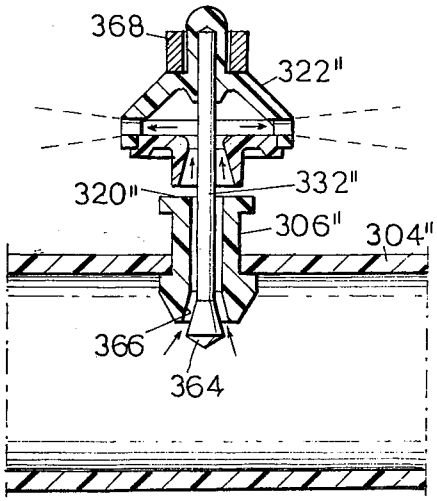
FIG.11

ROTARY SPRAYING DEVICE PARTICULARLY USEFUL FOR WATER IRRIGATION

BACKGROUND OF THE INVENTION

The present invention relates to rotary liquid spraying devices, and particularly to rotary water spraying devices useful for water irrigation.

A number of different types of rotary water spraying devices are used in irrigation, including rotary sprinklers, sprayers, and devices called "micro-jets" which distribute a relatively small quantity of water for a short distance about the device. Such known devices are usually of relatively costly construction, and/or are not entirely satisfactory with respect to the uniformity or range of water distribution.

An object of the present invention is to provide rotary liquid spraying devices having advantages in the above respects and particularly useful for water irrigation.

SUMMARY OF THE INVENTION

The present invention provides a rotary liquid spraying device, comprising: a nozzle connectable to a pressurized liquid source, a nozzle support for supporting the nozzle to issue a jet along a first axis, a liquid spraying head, and a rotatable mounting for the head to enable rotation about said first axis. The liquid spraying head includes an internal chamber receiving the jet via an inlet, and a plurality of outlet orifices communicating with the internal chamber and aligned with other axes each at an angle to and laterally of the first axis to issue jets therealong and to produce a reaction force rotating the head about the first axis. The internal chamber is of substantially larger cross-sectional area than either the inlet, or all the outlet orifices together, to define a reservoir in which the velocity of the nozzle jet is substantially reduced and is used to pressurize the liquid before it issues at a high velocity through the outlet orifices.

The inlet orifice is preferably shaped to include side walls converging towards each other in the direction of the inlet chamber and terminating in a narrow diameter throat at the mouth of the chamber.

Several embodiments of the invention are described below for purposes of example. In some, the rotatable mounting for the head includes a pin disposed in alignment with the nozzle and rotatably mounting the head with its inlet in alignment with the nozzle.

The device may include a pair of spraying head. The nozzle issues a pair of jets both along the same axis but in opposite directions, the pin being rotatably mounted within the nozzle and carrying the pair of spraying heads on its opposite ends to intercept the oppositely directed jets issuing from the nozzle.

Liquid spraying devices constructed in accordance with the foregoing features obviate the need for seals for the rotating spraying head since this function is substantially accomplished by the interception of the jet from the nozzle by the shaped inlet orifice of the rotary head. In addition, it has been found that such spraying devices effect a very good distribution of the liquid. The embodiment including the two spraying heads mounted on opposite ends of the pin, provides a further advantage in that it produces a balanced arrangement for the two rotating heads thereby obviating the need of a bearing for the head.

BRIEF DESCRIPTION OF THE DRAWINGS

The invention is herein described, by way of example only, with reference to the accompanying drawings, wherein:

FIG. 1 is a sectional view of one form of liquid spraying device constructed in accordance with the invention particularly useful for water irrigation;

FIG. 1*a* is a sectional view along lines A—A of FIG. 1;

FIG. 1*b* is an enlarged view of the inlet orifice of the spraying head of FIG. 1;

FIG. 2 is a sectional view of another form of liquid sraying device constructed in accordance with the invention particularly useful for water irrigation;

FIG. 2*a* is an enlarged view illustrating the two spraying heads of FIG. 2 in transverse section;

FIG. 2*b* is an enlarged fragmentary view illustrating a modification in the device of FIG. 2*a*.

FIGS. 9–13 are sectional views illustrating further modifications of spraying heads, FIG. 13 being a sectional view along lines V—V of FIG. 12.

DESCRIPTION OF THE PREFERRED EMBODIMENTS

Figure 3:
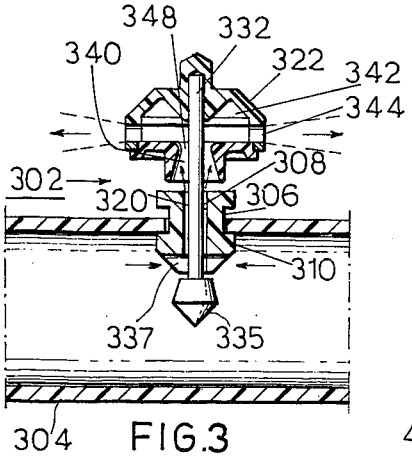
FIGS. 3–6 and 6*a* are longitudinal sectional views illustrating four variations of the liquid spraying devices of FIGS. 1 and 2 above.

The water spraying device, generally designated 2, in FIG. 1 is designed for direct mounting to a water supply pipe 4, and for this purpose it includes a vertical stem 6 formed with a through-going bore or passageway 8 and a pointed tip 10 adapted to be inserted through an aperture in the wall of water supply pipe 4. Stem 6 is formed with a pair of spaced annular shoulders, namely outer shoulder 12 and inner shoulder 14, defining a space 16 between them for receiving the wall of pipe 4. The rear face 18 of the outer shoulder 12 is flat so as to firmly engage the inner surface of the wall of pipe 4 when the pipe is supplied with water under pressure, which pressure forces stem 6 upwardly against the inner surface of the pipe wall.

The upper end of stem 6 terminates in the nozzle 20 which produces a jet of water 20' tapped from the supply pipe 4. This jet travels along a vertical axis 21 and is intercepted by a rotary spraying head, generally designated 22, which in turn is rotated about the same vertical axis 21 and issues a plurality of horizontal jets as will be described more particularly below.

Rotary spraying head 22 is rotatably suspended above nozzle 20 by means of a curved arm 26 fixed at its lower end to the nozzle and carrying at its upper end a bearing housing 28. The latter includes a bottom apertured wall 30 freely receiving a pin 32 fixed at its lower end to the spraying head 22 and rotatably retained within bearing housing 28 by a retainer clip 34. The upper end of pin 32 is pointed, as shown at 36, and is adapted to engage a bearing plate 38 carried by a closure member 40 at the upper end of housing 28.

The rotary spraying head 22 is formed with a shaped inlet orifice 40 vertically spaced from nozzle 20 and aligned with it along vertical axis 21 so as to intercept the vertical jet 20' issued by that nozzle. Head 22 further includes an internal chamber 42 communicating with inlet orifice 40, and one or more (four being present in the illustrated embodiment, as shown in FIG. 1*a*) outlet orifices 44 communicating with internal chamber 42. Each outlet orifice 44 has a horizontal axis 45 displaced laterally of the vertical axis 21 of vertical jet 20'.

As shown particularly in FIG. 1*b*, the inlet orifice 40 includes side walls 46 converging towards each other in the direction of the inlet chamber 42 and terminating in a narrow-diameter throat 48 at the mouth of the chamber. Directly above throat 48 is a conical deflector wall 50 which deflects the vertical incoming jet 20' in the horizonal direction to the outlet orifices 44, from whence they issue as horizontal jets 44'. Since these outlet orifices are laterally displaced from the vertical axis 21 of rotation of the spraying head 22 (FIG. 1*a*), the issuance of the horizontal jets 44' through outlet orifices 44 produces a reaction force rotating the head about its vertical axis 21.

As clearly shown in FIGS. 1 and 1*b*, the interior chamber 42 is of substantially larger cross-sectional area than that of either the inlet orifice 40, or of all the outlet orifices 44 taken together. Chamber 42 thus defines a relatively-large reservoir in which the velocity of the water jet 20' from the nozzle 20 is substantially reduced. Such a reservoir thus interrupts the incoming jet, utilizes its energy for pressurizing the water in the internal chamber, and transfers the energy to the jets exiting through the outlet orifices. It has been found that such an arrangement better enables directing the exiting jets to the desired directions (preferably substantially horizontal in under-tree irrigation) and at greater ranges, particularly when small quantities of water are distributed, than the known reaction-type sprinklers wherein the water is merely directed by a guide or channel, without a significant change in velocity, from an inlet to one or more lateral outlets.

The converging side walls 46 of the inlet orifice 40 preferably form, with the vertical axis 23 of the inlet orifice, a small acute angle ($\alpha$, FIG. 1*b*) in the order of 10°–20°. Thus, the portions of the vertical jet 20' impinging these side walls 46 will be deflected by them upwardly through throat 48 of the orifice and into the internal chamber 42. This inrushing of the water into chamber 42 produces, in effect, a form of seal which prevents the water within chamber 42 from exiting through orifice 40, forcing the water to exit through the horizontal orifices 44 in the form of the horizontal jets 40'. Thus, no special seal is required between the rotating head 22 and the fixed parts of the device.

For purposes of example, the diameter of the vertical jet 20' at the point of impingement on converging walls 46 of the inlet orifice may be about 1.5–2mm, the angle $\alpha$ may be about 15°, and the throat 48 of the inlet orifice may be about 1.5 mm.

The device illustrated in FIG. 1 has been found particularly effective in producing a fine distribution or spray of water over an area in the order of 4 meters radius, and therefore is eminently suitable for use as a micro-jet for under-tree irrigation. It will be appreciated that all the parts of the device may be constructed of plastics material.

FIG. 2 illustrates another form of water spraying device constructed in accordance with the invention particularly useful as a micro-jet for under-tree irrigation. The device of FIG. 2, therein generally designated 102, is also constructed for direct mounting on a water supply pipe 104, and includes a stem 106 adapted to be received within the apertured wall of the pipe. Stem 106 is also formed with the two spaced annular shoulders 112 and 114, as in the FIG. 1 embodiment, except that the tip of the stem is closed by an end wall 110 and is provided with a plurality of openings 111 extending through its side wall for filtering the water passing into the spraying device from the water supply pipe 104. It will be appreciated that the same type of arrangement could also be included in the FIG. 1 embodiment.

A bore or passageway 108 is formed through the stem and supplies water from pipe 104 to a pair of aligned, oppositely directed nozzles 120*z* and 120*b*. These nozzles issue a pair of jets along the same vertical axis 121 but in opposite directions; i.e., the jet from nozzle 120*a* moves upwardly and the jet from nozzle 120*b* moves downwardly. Each of the two vertical jets is intercepted by a rotatable head 122*a*, 122*b*, each constructed substantially the same as head 22 in FIG. 1. Thus, each head includes an inlet orifice 140 for intercepting its respective vertical jet, an internal chamber 142 communicating with the inlet orifice, and a plurality (preferably four) horizontally extending outlet orifices 144 whose horizontal axes 145 are laterally displaced with respect to the vertical axis 121 of rotation of the head in order to produce reaction forces rotating the head about its vertical axis 121. The two heads 122*a*, 122*b* are secured together by a pin 132 passing through the vertically aligned nozzles 120*a*, 120*b*. Pin 132 is of smaller diameter than the openings of the nozzles, and the throats 148 of the heads, to permit the vertical jets from the nozzles to enter the internal chambers 144 of the respective heads.

The device of FIG. 2 operates substantially as described above with respect to FIG. 1, except that in this case the two vertically issuing jets apply substantially equal and opposite vertical forces against their respective heads 122*a*, 122*b*, so as to balance the heads and their connecting pin 132 within the nozzle openings during the rotation of the head, providing a bearingless, low-friction mounting for the two-head assembly.

Because of this low-friction mounting, the head assembly may rotate too rapidly, which would tend to unduly shorten the range of distribution of the water issuing from the device. FIG. 2*a* illustrates an optional arrangement that may be used in order to reduce the speed of rotation of the head assembly.

As shown in FIG. 2*a*, the outlet openings 144*a*, 144*b* of the two spraying heads 122*a*, 122*b* are displaced laterally in opposite directions and in unequal amounts from the vertical axis 121 of rotation of the head to provide a relatively small resultant reaction force for rotating the heads. Thus, the axis 145*a* of outlet openings 144*a* in head 122*a* is displaced by the distance "*x*" from one side of the axis 121; whereas the axis 145*b* of outlet openings 144*b* in head 122*b* is displaced a smaller distance "*y*" from the opposite side of the axis 121. The reaction force produced by the issuance of the jets from the outlet openings in the two heads 122*a*, 122*b* will therefore oppose or buck each other, but since the reaction force produced from head 122*a* is larger, the head assembly will rotate in that direction (clockwise in FIG. 2*a*) at a relatively low speed.

FIG. 2*b* illustrates a modification in the arrangement of FIG. 2. In this modification, the pin 221 rotatably mounting the two heads (not shown) is formed with an annular shoulder 223 at its mid-point disposed between the two nozzles 220*a*, 220*b*. The two faces of annular shoulder 223 are tapered, as shown at 224, first inwardly and then outwardly as they converge towards, but are always spaced from the side walls 246 of the inlet orifices of the two heads. This optional arrangement tends to self-center pin 221 and the two heads connected to the pin.

FIG. 3, illustrates a modified water spraying device, generally designated 302, which is also directly mounted to the water supply pipe 304. For this purpose, it includes a vertical stem 306 formed with a through-going bore or passageway 308 and a pointed tip 310 adapted to be inserted through an aperture in the wall of water supply pipe 304. The upper end of stem 306 terminates in a nozzle 320 which produces a vertical jet of water intercepted by a spraying head 322 rotatable about the vertical axis of the jet from nozzle 320. Spraying head 322 is generally of the same construction as in FIGS. 1 and 2 described above, including a shaped inlet orifice 340, an internal chamber 342, and a plurality of outlet orifices 324 for issuing horizontal jets, which horizontal jets are laterally displaced from the vertical axis of rotation of the spraying head so as to produce a resultant reaction force rotating the head.

According to the modification illustrated in FIG. 3, head 322 is fixed to the upper end of a pin 332 of smaller diameter than the throat 348 of the head. Pin 332 loosely passes through the head and the vertical bore 308 of the nozzle, the pin terminating at the opposite end in a stop 335 of larger diameter than bore 308 of the nozzle.

The arrangement is such that the pin 332 and the head 332 carried thereby are freely mounted within nozzle 320 so that during the operation of the device, the force of the vertical jet issuing from the nozzle raises the head and rotates it with respect to the nozzle by the above-described reaction forces produced by the horizontal jets issuing from the nozzle outlet orifices 344; whereas during the non-operation of the device, the head drops by gravity to overlie and cover the nozzle 320.

The arrangement illustrated in FIG. 3 requires but a few simple parts which can be manufactured and assembled at low cost. It has the further advantage of closing the nozzle opening when the device is not operating, thereby protecting the nozzle from becoming clogged by foreign matter, such as sand or insects, during long periods of non-use.

In the arrangement illustrated in FIG. 3, the through-going passageway or bore 308 formed in stem 306 extends through the tip 310 of the stem disposed within the water supply pipe 304, and includes a plurality of radially-extending, circumferentially spaced, vanes 337 engagable with stop 335 of the pin to space the stop from the tip of the stem and thereby to provide communication between passageway 308 and the interior of the water supply pipe 304.

Figure 4:
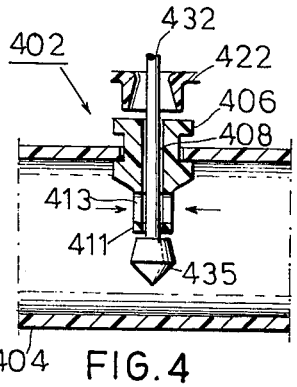

FIG. 4 illustrates a device 402 wherein the tip of its stem 406 is closed by a transverse wall 411 and is formed with a plurality of radial openings 413 through its side wall near its tip to provide communication between passageway 408 through the nozzle and the interior of the liquid supply pipe 404. Otherwise, the structure is substantially the same as described above with reference to FIG. 3, and includes a pin 432 fixed at its upper end to the sprayer head 422 and carrying the stop 435 at its lower head to permit the floating mounting of the pin and spraying head as described above with respect to FIG. 3.

Figure 5:
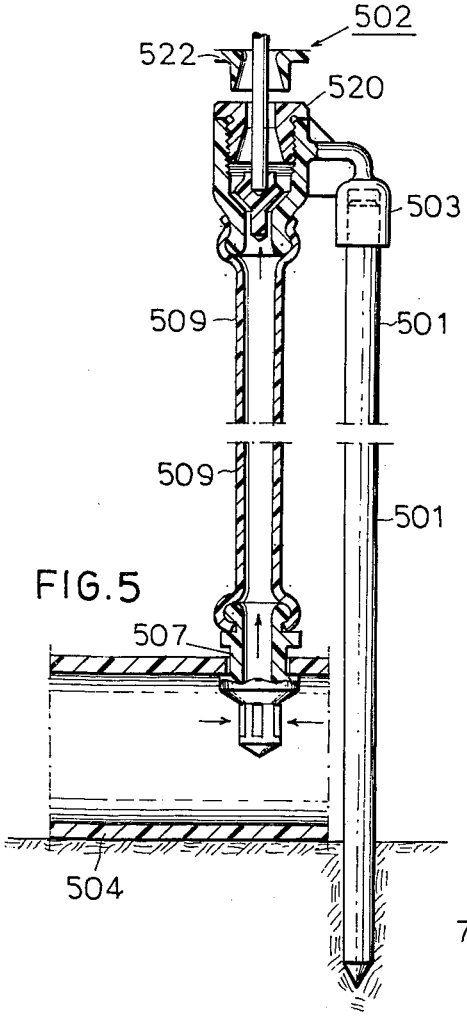

FIG. 5 illustrates a further variation, wherein the spraying device is mounted on a vertical rod-shaped mounting member or stake 501 adapted to be inserted into the ground at its lower end and adapted to carry the spraying device, generally designated 502, at its upper end. For this purpose, the nozzle support includes a socket member 503 fixed to the nozzle 520, which socket member is adapted to be seated over the top of the vertical mounting stake 501. The nozzle 520 receives pressurized water from the water supply pipe 504 by means of a stem 507 inserted through an apertured wall in the water supply pipe and connected to the inlet end of the nozzle via a flexible tube 509. The arrangement illustrated in FIG. 5 may be used when it is desired to mount the rotatable spraying head 522, receiving the vertical jet from nozzle 520 and producing horizontal jets as described above, at a higher elevation than the water supply pipe.

Figure 6A:
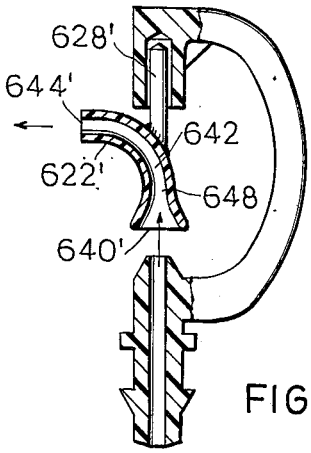
Figure 6:
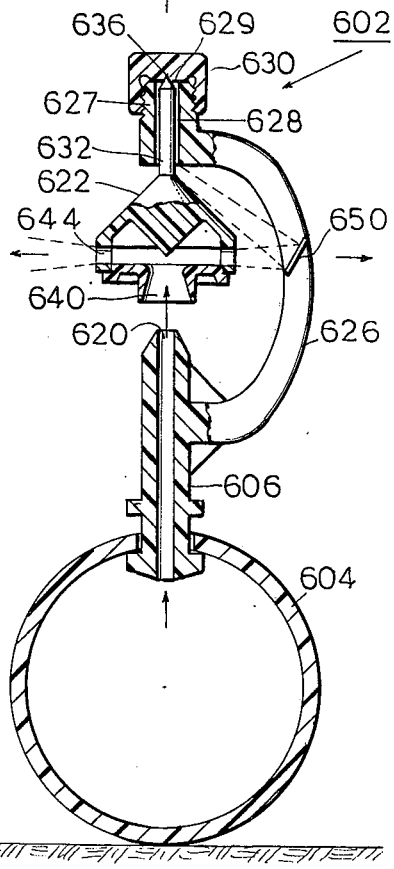

A further variation is illustrated in FIG. 6, wherein it will be seen that the spraying device, generally designated 602, is generally similar to that illustrated in FIG. 1. Thus, the spraying device is directly mounted to a water supply pipe 604 via a stem 606 whose upper end terminates in the nozzle 620, and the rotatable spraying head 622 is rotatably mounted about the vertical axis of nozzle 620 by means of a curved arm 626. FIG. 6, however, includes a simplified rotatable mounting for head 622, this mounting including a cylindrical member 627 having a bore 628 aligned with the nozzle, the upper end of the bore being closed by a transverse wall 629, which may be part of a cap 630 received (e.g. by threads) over member 627. A pin 632 is fixed at its lower end to the rotary head 622, and its upper end is pointed as shown as 636.

The inlet orifice 640 of the rotary head 622 intercepts the vertical jet as described above and is raised by the jet until pointed end 636 of pin 632 engages wall 629, this pointed end providing a low-friction contact which wall 629 as head 622 is rotated by the reaction forces produced by the jet issuing from the horizontal outlet orifices 644, as described above. When the device is not operating, head 622 drops by gravity and covers the outlet of nozzle 620 to protect it from clogging by dirt and other foreign particles during periods of non-use, as described above with respect to FIG. 3.

The arrangement illustrated in FIG. 6 includes a further feature, namely a deflector 650 carried by arm 626 in position so as to intercept a small quantity of the horizontally-issuing jets, and to deflect the intercepted portion to pin 632 rotatably mounting the spraying head 622. Thus, the pin is continuously wetted, and therefore lubricated, by the deflected water.

FIG. 6*a* illustrates a variation in the arrangement of FIG. 6, wherein the head 622' includes only one outlet orifice 644'. Head 622' is therefore of a curved cylindrical shape formed with a single bore defining the inlet 640', the internal chamber 642 communicating with the outlet orifice 644', and the narrow-diameter throat 648 between the inlet 640' and the internal chamber 642. As in the FIG. 6 arrangement, head 622' rotates about the axis of vertical pin 628' to which it is fixed, and the outlet orifice 644' is laterally displaced from the axis of pin 628' so as to produce the reaction force for rotating the head.

Figure 7:
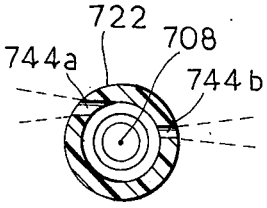
FIGS. 7 and 8 are transverse sectional views illustrating two further variations in the spraying heads.

FIG. 7 illustrates a still further variation that may be used with respect to outlet orifices of the rotary spraying head, generally designated 722. In FIG. 7, the vertical axis of rotation of the spraying head is designated 708, and the head is illustrated as including two horizontal outlet orifices 744*a* and 744*b* which are laterally displaced with respect to axis 708 to produce reaction forces of unequal amounts in opposite directions and thereby to provide a relatively small resultant force to rotate the head. The arrangement of FIG. 7 is particularly useful when it is desired to rotate the head at a relatively low speed so as to increase the diameter of distribution of the water around the sprayer.

Figure 8:
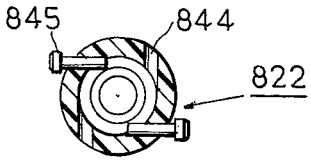

FIG. 8 illustrates a still further variation, wherein the head, generally designated 822, includes a plurality (four being illustrated) of outlet orifices 844, but also includes one or more (two being illustrated) plugs 845 insertable into selective orifices 844 to block the flow through the respective orifices. The arrangement of FIG. 8 is particularly useful when it is desired to increase the velocity of the jets issuing from the outlet orifices 844 by selectively plugging one or more of these orifices, since the more orifices that are plugged, the greater will be the quantity of water issuing from the remaining orifices, and therefore the greater will be the diameter of distribution of the water around the spraying device.

FIG. 9, illustrates a spraying head substantially the same as that illustrated in FIG. 3, except that the pin, rotatably mounting the spraying head to the nozzle, is fixed to the nozzle and rotatably mounts the spraying head, rather than being fixed to the spraying head and rotatably mounted to the nozzle as in FIG. 3. Thus, as shown in FIG. 9, the pin 332' is not loosely mounted within bore 308' of stem 306', as in FIG. 1, but rather is fixed within the bore by having its bottom tip embedded in the bottom wall 360 of the nozzle. The diameter of pin 322', however, is still less than the diameter of bore 308', to permit the water to flow from pipe 304', through stem 306' and nozzle 320', to the rotary head 322'. Head 322', instead of being fixed to pin 332', is rotatably mounted to the pin by means of a bore 333 formed at the top of the head through which bore the upper end of pin 332' passes and terminates in a spherical stop 362.

It will be appreciated that the device illustrated in FIG. 9 operates substantially the same as that illustrated in FIG. 1, except for the fact that the pin 332' is fixed to the nozzle 320' and rotatably mounts the head 322'.

FIG. 10 illustrates a similar modification with respect to the liquid spraying device illustrated in FIG. 6. Thus, whereas in FIG. 6 the pin was rotatably mounted to the support arm, in the modification of FIG. 10, the pin 628' is fixed to the support arm 626' at the top 660 of the support arm, and rotatably mounts the spraying head 622' in alignment with the nozzle 606'. The operation of the device is otherwise the same as described with respect to FIG. 6.

FIG. 11 illustrates a further modification in a spraying device of the type of FIGS. 3 and 9, wherein the spraying device is provided with a regulator to regulate the flow of water entering the nozzle 320" from the supply pipe 304" via stem 306". For this purpose, pin 322" is provided with a conical valve member 364 at its lower end which cooperates with a conical inlet 366 in stem 306". Also, the rotary head 322", fixed at its upper end to pin 332", is provided with a weight 368, for example a metal ring embedded in the head. The arrangement is such that should there be an increase in the supply line pressure, head 322" would tend to rise, bringing conical valve member 364 closer to conical inlet 366, and thereby restricting the flow of the water fed into the stem 306". Thus, head 322" floats within stem 306" to maintain a substantially constant output.

FIGS. 12 and 13 illustrates a further modification for regulating the rotational speed of the spraying head upon changes in pressure in the water supply line. The spraying head illustrated in FIGS. 12 and 13 most closely resembles that illustrated in FIG. 2, and therefore similar parts carry corresponding reference numerals with the addition of the "prime" symbol.

Thus, as shown in FIGS. 12 and 13, two spraying heads **122*a'* and 122*b'* are mounted on a pin 132' received within a sleeve defining a pair of nozzles 120*a'* and 120*b'*, one for each of the heads. As described above with respect to FIG. 2, as the water flows into the two heads and exits through their outlet openings 144', a reaction force is produced rotating the two heads, together with the pin 132', with respect to arm 108' which is connected by stem 106' to the water supply pipe 104'. A regulating device is provided for regulating the rotational speed of the heads upon pressure changes in the water supply pipe 104' since the rotational speed of the head will affect the water distribution range. Thus, pin 132' includes a plurality of vanes 160 which are oriented to produce a rotary torque by the flow of the liquid from stem 106' to the two nozzles 120*a'*, 120*b'*, the rotary torque produced by vanes 160 being opposed to the reaction force produced by the jet issuing from the outlet openings 144' in the rotary heads. Thus, vanes 160** tend to dampen any changes in the rotational speed resulting from changes in the water supply line pressure and thereby tend to maintain a substantially uniform rotational speed.

What is claimed is:

1. A rotary liquid spraying device particularly useful for water irrigation, comprising: a nozzle connectable to a pressurized water source; a nozzle support for supporting the nozzle to issue a jet along a substantially vertical axis; a water spraying head; and a rotatable mounting for the head to enable same to rotate about said vertical axis; said head including an inlet orifice having a mouth vertically aligned with said nozzle to intercept the jet from the nozzle, an internal chamber communicating with said inlet orifice, and a plurality of outlet orifices communicating with said internal chamber and having substantially horizontal axes each laterally of said vertical axis to issue jets therealong and to produce a reaction force rotating the head about the vertical axis; said internal chamber being of substantially larger cross-sectional area than either the inlet orifice, or all of the outlet orifices together, to define a reservoir in which the velocity of the incoming liquid is reduced and is utilized to pressurize the liquid before issuing as jets through the outlet orifices, said inlet orifice including side walls converging towards each other from its mouth towards the internal chamber and terminating in a narrow diameter throat at the mouth of said chamber.

2. A device according to claim 1, wherein the top wall of said internal chamber includes a conical deflector for deflecting the jet entering the inlet orifice horizontally to said outlet orifices.

3. A device according to claim 1, wherein said nozzle support includes a stem carried at one end for insertion into the apertured wall of a water supply pipe and formed with a through-going passageway for conducting the water from the pipe to the nozzle.

4. A device according to claim 1, wherein said rotatable mounting for the head includes a pin disposed in alignment with the nozzle and rotatably mounting the head with its inlet in alignment with the nozzle.

5. A device according to claim 4, wherein said device includes a pair of spraying heads, and said nozzle issues a pair of jets both along the same axis but in opposite directions, the opposite ends of said pin rotatably mounting said pair of spraying heads to intercept the oppositely directed jets issuing from the nozzle.

6. A device according to claim 5, wherein the outlet orifices of the pair of spraying heads are displaced laterally in opposite directions and in unequal amounts from said axis of rotation of the heads to provide a relatively small resultant reaction force for rotating said heads.

7. A device according to claim 5, wherein said pin is formed with an annular shoulder at its mid-point disposed within said nozzle, both faces of said annular shoulder being tapered.

8. A rotary liquid spraying device according to claim 4, wherein said nozzle includes a vertical bore, said pin passing through the vertical bore and floatingly mounting the head to permit the head to rise under the force of the jet and to rotate with respect to the nozzle during the operation of the device, and to drop by gravity to cover the nozzle during the non-operation of the device.

9. A device according to claim 8, wherein said pin loosely passes through the vertical bore and has a stop of larger diameter than the vertical bore fixed at its end opposite to the head.

10. A rotary liquid spraying device according to claim 9 further including a regulator comprising a valve member fixed to said opposite end of the pin and cooperable with the inlet of said bore for regulating the flow of fluid therethrough.

11. A device according to claim 8, wherein the nozzle support is in the form of a stem insertable into the apertured wall of a liquid supply pipe and formed with a through-going passageway for conducting the liquid from the pipe to the nozzle.

12. A rotary liquid spraying device according to claim 4, further including a regulator for regulating the rotational speed of the spraying head, comprising a plurality of vanes fixed to said pin and oriented to produce a rotary torque by the flow of fluid to the nozzle, which rotary torque opposes the reaction force produced by the jet issuing from the spraying head.

* * * * *